United States Patent [19]

Hu

[11] Patent Number: 4,600,258

[45] Date of Patent: Jul. 15, 1986

[54] SECURITY SOCKET

[76] Inventor: Andrew Hu, No. 7-3, Lane 58, Po-Ai St., Tan Shuei, Taipei Hsien, Taiwan

[21] Appl. No.: 758,069

[22] Filed: Jul. 23, 1985

[51] Int. Cl.[4] ..... H01R 13/44

[52] U.S. Cl. ..... 339/40; 339/36

[58] Field of Search ..... 339/36, 40, 41, 42

[56] References Cited

U.S. PATENT DOCUMENTS 4,206,957 6/1980 Ludwig et al. ..... 339/40

4,257,659 3/1981 Gibbs ..... 339/40

FOREIGN PATENT DOCUMENTS 1436611 5/1976 United Kingdom ..... 339/40

1489569 10/1977 United Kingdom ..... 339/40

*Primary Examiner*—Gil Weidenfeld

*Assistant Examiner*—Paula A. Austin

*Attorney, Agent, or Firm*—Lowe, Price, LeBlanc, Becker & Shur

[57] ABSTRACT

A safety socket comprising a socket, a partition board, a hood and a cover is disclosed. A sliding partition board mounted between the socket and the hood is provided. One end of the partition board covers the socket and the other end extends to the outer part of the socket to form a handle. Two spots are provided in the main body of the partition board which correspond to the receptacles of the socket. On the underside of the partition board a column protrudes with a spring chamber retaining a spring. When the socket is not in use the spring loaded partition board automatically disaligns itself with the receptacles. To use the socket, simply pull back on the handle until the receptacles and the slots on the partition board are aligned.

1 Claim, 6 Drawing Figures

SECURITY SOCKET

BACKGROUND OF THE INVENTION

The present invention relates to a safety socket which uses a moveable partition board with slots corresponding to receptacles of the socket so that while the socket is not in use, the slots are not aligned with the receptacles to prevent from insertion of any material for safety purpose.

Generally, each house has a number of sockets for electric appliances. All such sockets are usually located not so high above floor. Shock by current from these socket is a danger to life, particularly to children who are not aware of how dangerous the electricity is and by official statistic figure that everyday we have many children shocked by the electric appliance and the exposed plug socket is considered to be the main danger to all. Insertion of finger or metal rod into socket will cause shock. The danger will be of higher degree at high voltage power supply, such as those for industry, than which of low voltage power supply, such as that for ordinary electric appliance.

The conventional sockets do not have proper protection against the danger. The present invention was created by the inventor after spending a considerable time in research, tests and improvements. It is a safety socket which can secure safety with simplest structure and it is ease in operation.

SUMMARY OF THE INVENTION

The main objective of the present invention is to provide a safety socket having a moveable partition board in between a socket and a hood in an arrangement which can align the slots at the partition board with the receptacles by moving the partition board for putting the socket in use, and to separate the slots from the receptacles automatically while the socket is not in use for safety purpose.

DETAILED DESCRIPTION OF THE PREFERRED EMBODIMENT

Figure 2:
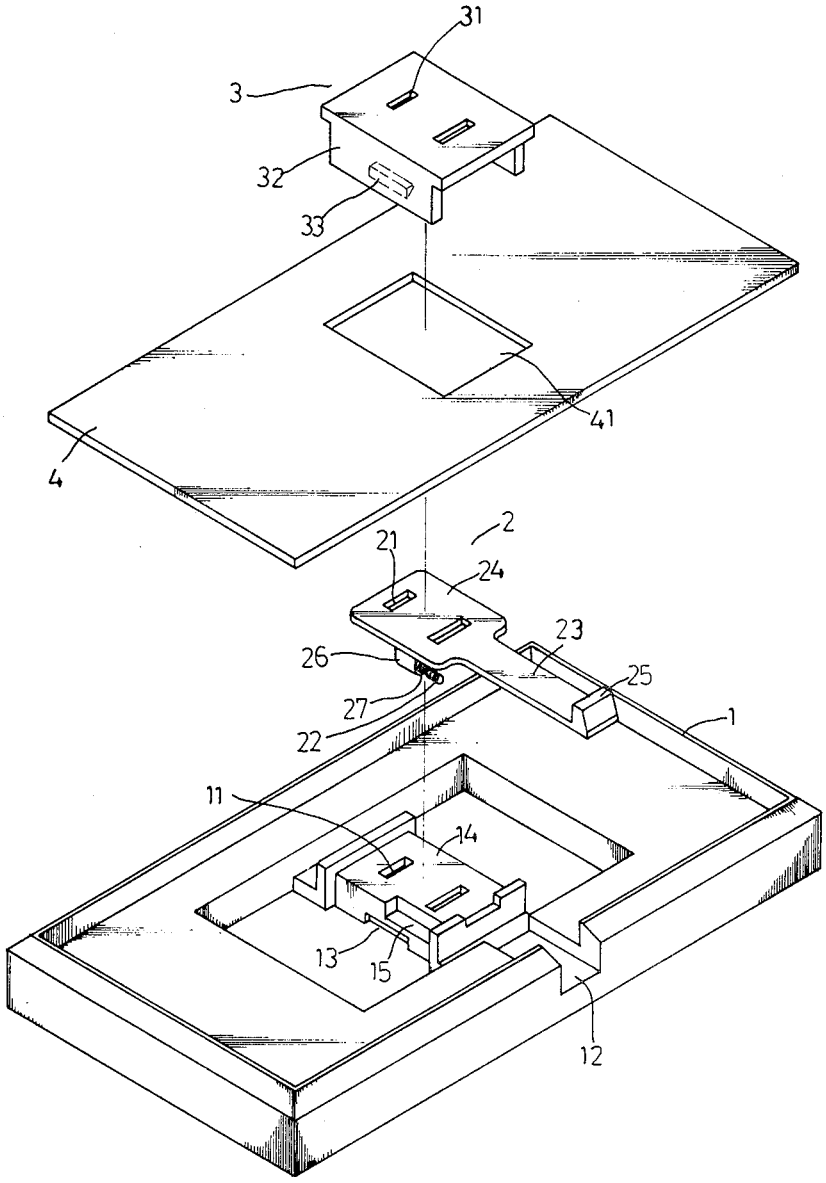
FIG. 2 is a fragmental perspective view of FIG. 1.

As illustrated in FIG. 2, the present invention is mainly composed of a socket (1), a partition board (2), a hood (3) and a cover (4). The socket (1) has a socket body (14) in the middle. Receptacle (11) is located on the socket body (14). There is a fixing slot (13) along the lower edge of the socket body (14) there is also a spring chamber (15). A partition board groove (12) is located at a side of the socket (1). The hood (3) has two side boards (32) at two sides. Each side board (32) has a hooked element (33) in the middle of its lower part. The hooked element (33) is for hooking the fixing slot (13) of the socket (1) to position the socket body (14) within the socket (1). There are two slots (31) on the hood (3). Which covering the socket body (14), and the slots (31) are aligned with the receptacle (11) of the socket body (14). The cover (4) has a rectangular opening (41) for holding the hood (3). The partition board (2) has an isolating part (24) in a dimension adapting to the size of the sooket body (14) and hood (3). There are two slots (21) on the partition board (2) corresponding to the receptacle (11). While the socket (1) is not in use, the slots (21) on the partition board (2) are not aligned with the receptacle (11). The partition board (2) has a end extending towards the partition board groove (12) on the socket (1) and at that end there is a handle (23) provided with a block (25) for moving the partition board (2). On the back of the isolating part (24) there is a column (26) with a spring chamber (27), to which an end of a spring (22) is fixed. While the partition board (2) is located on the socket body (14), the column (26) and the spring (22) can be positioned within the spring chamber (15) at the socket body (14) with an end of the spring pushing against the extenal wall of the spring chamber (15).

Figure 1:
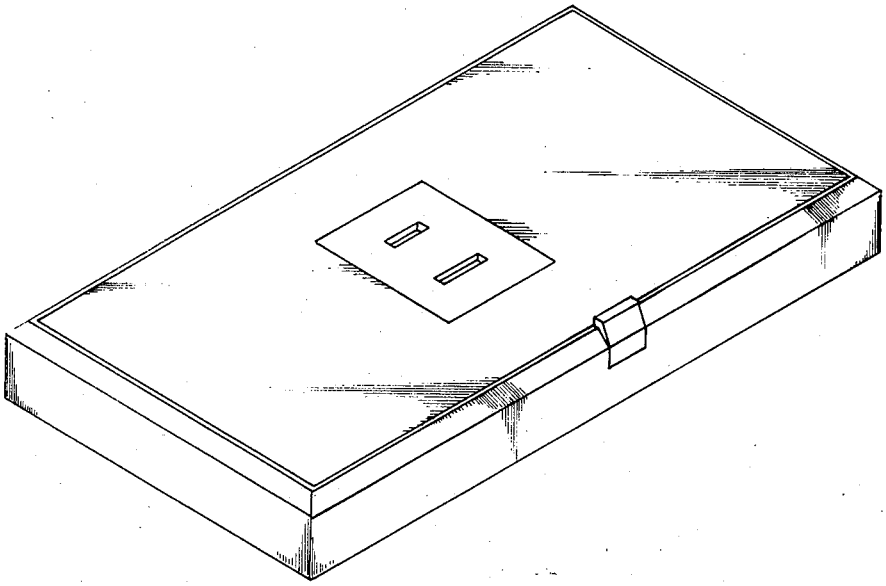
FIG. 1 is a perspective view of a preferred embodiment of the present invention.

An embodiment of the present invention is illustrated in FIG. 1. In the embodiment, an end of the spring (22) is placed within the chamber (27) at the column (26) and the partition board (2) is placed over the socket (1) with its handle (23) in the partition board groove (12) and the isolating part (24) over the socket body (14). At this state, the column (26) and the spring (22) under the partition board (2) is positioned within the spring chamber (15) at the socket (1). The hood (3) is for covering the socket body (14) and the isolating part (24) with its hooked element (33) hooking the fixing slots (13) on the socket (1). The cover (4) is used to cover the socket (1) to form the complete embodiment.

Figure 3:
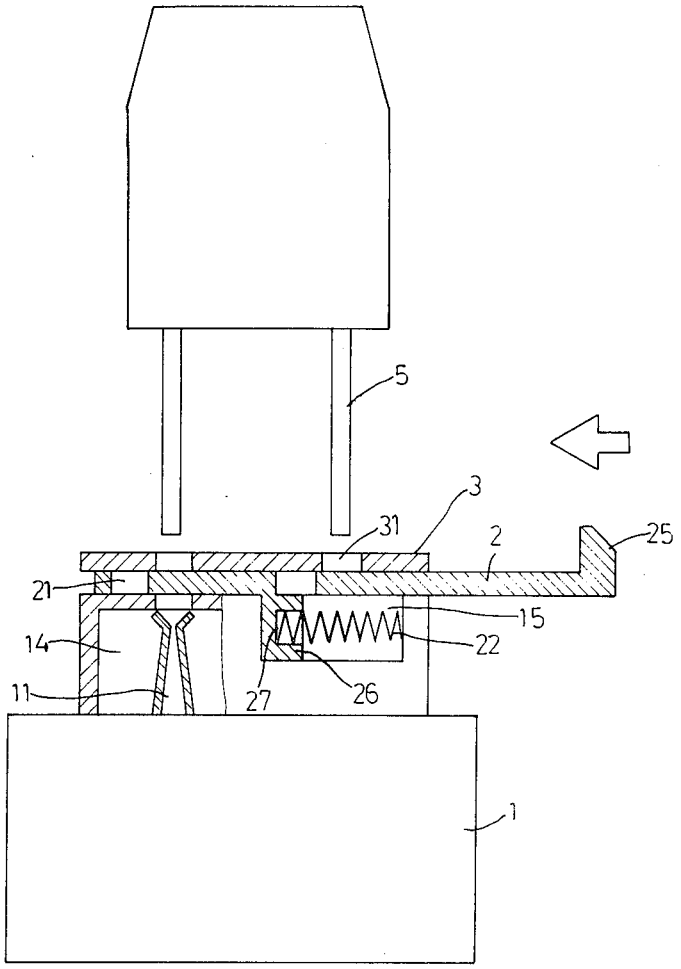
FIGS. 3, 4, 5 and 6 illustrate using of the present invention.
Figure 4:
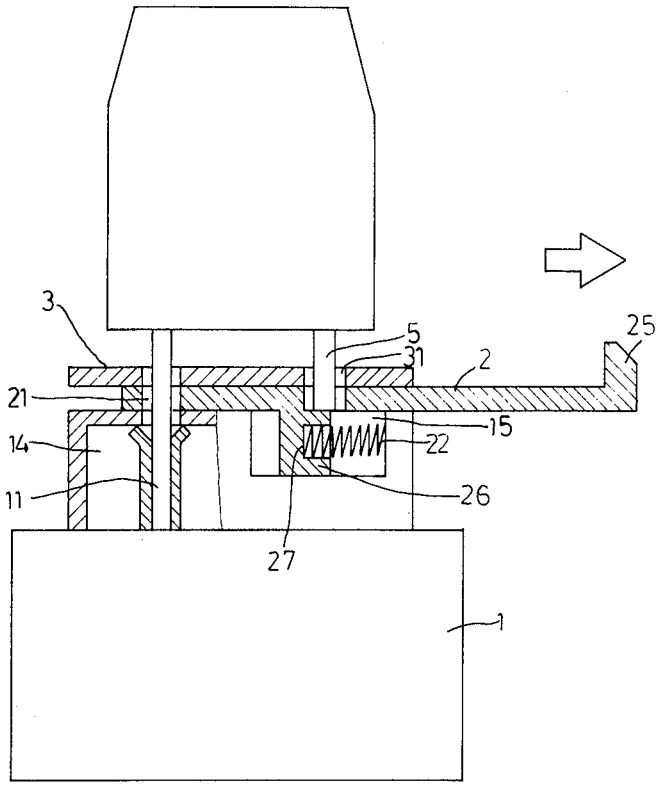

Please refer to FIG. 3 and FIG. 4 for application of the present invention. As shown in FIG. 3, while the socket (1) is not in use, since an end of the spring (22) is pushing against the chamber (27) at the column (26) and its other end is pushing against the spring chamber (15) at the socket (1), the partition board (2) is subject to the compression of the spring (22) and positioned over the socket body (14). At this stage, the slots (21) of the partition board (2) are not aligned with the receptacle (11). In other words, the receptacle (11) is covered by the partition board (2) so that nothing can be inserted into the receptacle (11), and thus, safety is secured and no shocking or shortcircuit may occur. For putting the present invention to use, referring to FIG. 4, the partition board (2) is moved rightwards by pulling the block (25) in order to compress the spring (22) and the slots (21) at the partition board (2) are aligned with the receptacle (11) for inserting plug (5) into the receptacle (11).

Figure 5:
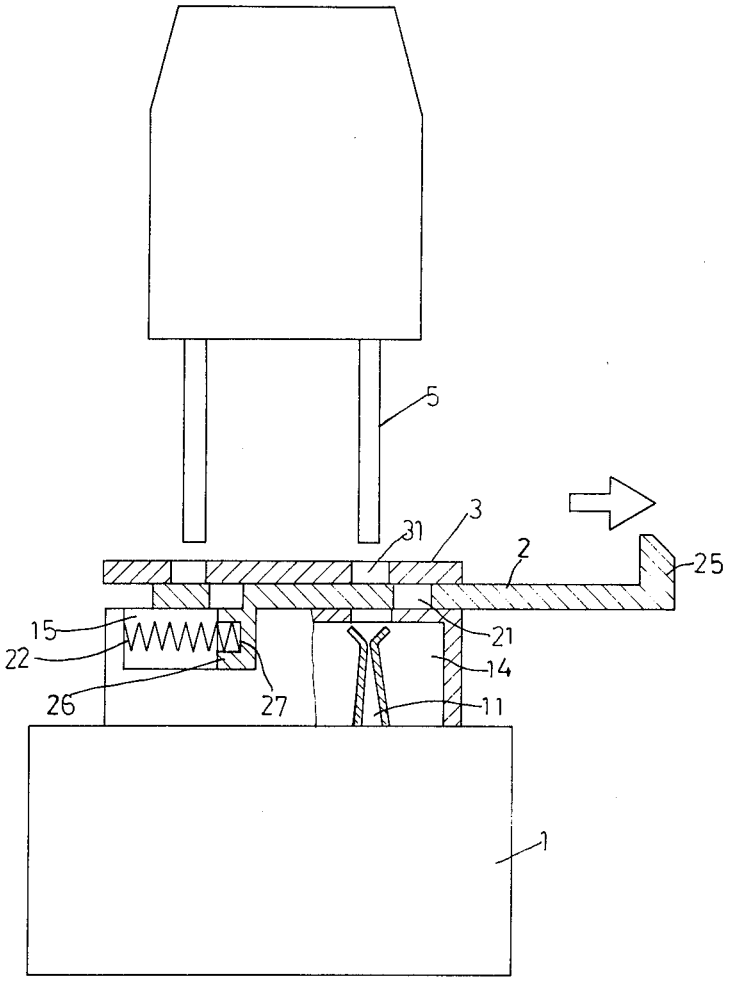
Figure 6:
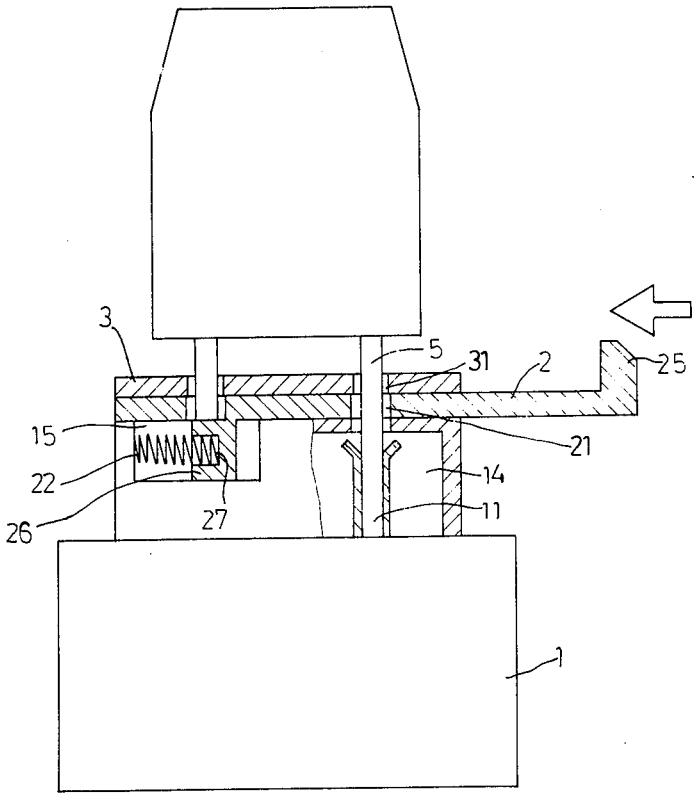

The present invention is characterized by the using of a partition board (2) over the socket body (14). As shown in FIGS. 2, 3 and 4, the partition board (2) has a column (26) with spring (22) beneath it. By pushing the partition board (2) leftwards, as illustrated in FIG. 6, the spring (22) is compressed, and the slots (21) at the partition board (2) are aligned with the receptacle (11) so that plug (5) can be inserted into the receptacle (11) and the socket (1) is put to use. While the socket is not in use, as shown in FIG. 5, the slots (21) at the partition board (2) are not aligned with but covering the receptacle (11), and thus safety is secured.

In conclusion, the present invention uses a partition board (2) over a socket (1) for safety and A protection purposes. It is a creative and new design which can certainly achieve the expected effect.

I claim:

1. A safety socket mainly comprising a socket, a partition board, a hood and a cover, the socket having a socket body at the middle, the socket body having two receptacles and the hood having two slots for insertion of plug, the socket body having a fixing slot at each lateral side and a spring chamber at one side, the socket having a partition board groove at one side, the hood having two side boards each with a hooked element for hooking the aforesaid fixing slots to secure the hood to the socket body, the partition board being placed in between the hood and the socket body and, having an isolating part in a dimension adapting to the size of the aforesaid hood and socket body, two slots and a column with a chamber being disposed beneath said isolating part, an end of a spring being fixed in the said chamber, and another end of the spring being pushing against an external wall of the spring chamber at the socket body, the partition board having an end extending towards the partition board groove on which the end is in a form of a block to function as a handle so that by pulling the block in a predetermind way, the slots at the partition board are aligned with the receptacles through compression of the spring and then the socket is ready for insertion of plug, and while the socket is not in use, the slots at the partition board are not aligned with but covering the receptacle to secure safety.

* * * * *